US011176915B2

(12) United States Patent
Yoshino et al.

(10) Patent No.: US 11,176,915 B2
(45) Date of Patent: Nov. 16, 2021

(54) SONG ANALYSIS DEVICE AND SONG ANALYSIS PROGRAM

(71) Applicant: AlphaTheta Corporation, Yokohama (JP)

(72) Inventors: Hajime Yoshino, Yokohama (JP); Kei Sakagami, Yokohama (JP); Toshihisa Sabi, Yokohama (JP)

(73) Assignee: ALPHATHETA CORPORATION, Yokohama (JP)

( * ) Notice: Subject to any disclaimer, the term of this patent is extended or adjusted under 35 U.S.C. 154(b) by 38 days.

(21) Appl. No.: 16/642,232

(22) PCT Filed: Aug. 29, 2017

(86) PCT No.: PCT/JP2017/030999
§ 371 (c)(1),
(2) Date: Feb. 26, 2020

(87) PCT Pub. No.: WO2019/043797
PCT Pub. Date: Mar. 7, 2019

(65) Prior Publication Data
US 2020/0357368 A1 Nov. 12, 2020

(51) Int. Cl.
*G10H 1/00* (2006.01)

(52) U.S. Cl.
CPC ..... *G10H 1/0008* (2013.01); *G10H 2210/056* (2013.01); *G10H 2210/076* (2013.01)

(58) Field of Classification Search
CPC ..... G10H 1/0008; G10H 2210/056; G10H 2210/076
(Continued)

(56) References Cited

U.S. PATENT DOCUMENTS 4,144,788 A * 3/1979 Bione ..... G10H 1/182 84/611
4,919,030 A * 4/1990 Perron, III ..... G04F 5/025 84/470 R
(Continued)

FOREIGN PATENT DOCUMENTS

JP 2007-052394 3/2007
JP 2007-156434 6/2007
(Continued)

OTHER PUBLICATIONS

Masataka Goto, "Real-time Beat Tracking for Musical Audio Signals", Proceedings of the Meeting of Special Interest Group on AI Challenges, Nov. 7, 1998 (Nov. 7, 1998), SIG-Challenge-9801-2, pp. 7 to 14, Listed in International Search Report, English abstract included, 8 pages.
(Continued)

*Primary Examiner* — Christina M Schreiber
(74) *Attorney, Agent, or Firm* — Rankin, Hill & Clark LLP

(57) ABSTRACT

A music piece analyzer includes: a beat-position-acquiring-unit configured to detect beat positions in music piece data; a snare drum detector configured to detect sounding positions of a snare drum in the music piece data; a bass drum detector configured to detect sounding positions of a bass drum in, the music piece data; a one-beat-shift-determination-unit configured to determine whether a bar beginning of the music piece data is shifted by one beat based upon the sounding positions of the snare drum detected by the snare drum detector; a two-beat-shift-determination-unit configured to determine whether the bar beginning of the music piece data is shifted by two beats on a basis of the sounding positions of the bass drum detected by the bass drum detector; and a bar-beginning-setting-unit configured to set the bar beginning of the music piece data on a basis of results
(Continued)

determined by the one-beat-shift-determination-unit and the two-beat-shift-determination-unit.

5 Claims, 9 Drawing Sheets

(58) Field of Classification Search
USPC ..... 84/609
See application file for complete search history.

(56) References Cited

U.S. PATENT DOCUMENTS 5,571,981 A * 11/1996 Miyamoto ..... G10H 1/0066 84/609
7,485,797 B2 * 2/2009 Sumita ..... G10H 1/383 84/609
7,582,824 B2 * 9/2009 Sumita ..... G10G 3/04 84/609
8,847,053 B2 * 9/2014 Humphrey ..... G09B 15/04 84/609
2005/0211072 A1 * 9/2005 Lu ..... G10H 1/40 84/612
2008/0034947 A1 * 2/2008 Sumita ..... G10H 1/383 84/613
2008/0034948 A1 * 2/2008 Sumita ..... G10H 1/40 84/636
2011/0317851 A1 * 12/2011 Hattori ..... G11B 27/038 381/98
2014/0341395 A1 * 11/2014 Matsumoto ..... H03G 3/20 381/107
2015/0013527 A1 * 1/2015 Buskies ..... G10H 1/40 84/611
2018/0033263 A1 * 2/2018 Novich ..... G10H 3/26
2019/0012995 A1 * 1/2019 Lupini ..... G10H 1/42
2019/0022351 A1 * 1/2019 McCarthy ..... A61M 21/00
2019/0090328 A1 * 3/2019 Sakagami ..... A63J 17/00
2019/0115000 A1 * 4/2019 Yoshino ..... G10H 1/0008
2020/0193947 A1 * 6/2020 Yoshino ..... G10H 1/0008
2020/0327898 A1 * 10/2020 Lou ..... G10H 1/40
2020/0357368 A1 * 11/2020 Yoshino ..... G10H 1/0008
2020/0357369 A1 * 11/2020 Wu ..... G10H 1/40

FOREIGN PATENT DOCUMENTS

JP 2010-122629 6/2010
JP 2014-010309 1/2014
JP 2014010309 A * 1/2014
JP 2014-029425 2/2014
JP 2015-079151 4/2015
JP 2015079151 A * 4/2015

OTHER PUBLICATIONS

International Search Report, dated Nov. 21, 2017 (Nov. 21, 2017), 2 pages.

* cited by examiner

SONG ANALYSIS DEVICE AND SONG ANALYSIS PROGRAM

TECHNICAL FIELD

The present invention relates to a music piece analyzer and a music piece analysis program.

BACKGROUND ART

It has been typically known to detect, as beat positions, kick positions and high sound-energy positions of a bass drum in digital music piece data (see, for instance, Patent Literature 1).

A method disclosed in Patent Literature 1 includes: acquiring bar positions in a music piece; equally dividing each of the acquired bar positions into a plurality of frequency spectrogram; and comparing a pattern in which a common component in the plurality of frequency spectrogram appears with predetermined rhythm patterns to determine a rhythm pattern of the music piece.

CITATION LIST

Patent Literature(s)

Patent Literature 1: JP 2015-079151 A

SUMMARY OF THE INVENTION

Problem(s) to be Solved by the Invention

However, in contrast to the disclosure of Patent Literature 1, when a beginning of a bar (also referred to as a bar beginning) is specified through detecting a beat position, an attack sound of the bass drum after a break in the music piece data is detected and a beat position of the detected sound is sometimes determined as the bar beginning, so that the beat position different from an actual first beat position of the bar of the music piece data is erroneously determined as the bar beginning.

An object of the invention is to provide a music piece analyzer and a music piece analysis program which do not erroneously detect a bar beginning.

Means for Solving the Problems

According to an aspect of the invention, a music piece analyzer includes: a beat position acquiring unit configured to detect beat positions in music piece data or the acquire beat positions detected by an external device; a snare drum position detector configured to detect sounding positions of a snare drum in the music piece data or acquire the sounding positions of the snare drum detected by an external device; a bass drum position detector configured to detect sounding positions of a bass drum in the music piece data or acquire the sounding positions of the bass drum detected by an external device; a bass drum position extractor configured to extract the sounding positions of the bass drum positioning one beat before the sounding positions of the snare drum; and a bar beginning setting unit configured to set, as a bar beginning, a first sounding position from a beginning of the music piece data, the first sounding position being one of the extracted sounding positions of the bass drum, at which position a sound power of the bass drum is above a predetermined threshold or more.

According to another aspect of the invention, a music piece analyzer includes: a beat position acquiring unit configured to detect beat positions in music piece data or the acquire beat positions detected by an external device; a snare drum detector configured to detect sounding positions of a snare drum in the music piece data or acquire the sounding positions of the snare drum detected by an external device; a bass drum detector configured to detect sounding positions of a bass drum in the music piece data or acquire the sounding positions of the bass drum detected by an external device; a one-beat shift determination unit configured to determine whether a bar beginning of the music piece data is shifted by one beat on a basis of the sounding positions of the snare drum detected by the snare drum detector; a two-beat shift determination unit configured to determine whether the bar beginning of the music piece data is shifted by two beats on a basis of the sounding positions of the bass drum detected by the bass drum detector; and a bar beginning setting unit configured to set the bar beginning of the music piece data on a basis of results determined by the one-beat shift determination unit and the two-beat shift determination unit.

According to still another aspect of the invention, a music piece analysis program enables a computer to function as: a music piece analysis program to be executed on a computer to function as a beat position acquiring unit configured to detect beat positions in music piece data or acquire beat positions detected by an external device; a snare drum detector configured to detect sounding positions of a snare drum in the music piece data or acquire the sounding positions of the snare drum detected by an external device; a bass drum detector configured to detect sounding positions of a bass drum in the music piece data or acquire the sounding positions of the bass drum detected by an external device; a one-beat shift determination unit configured to determine whether a bar beginning of the music piece data is shifted by one beat on a basis of the sounding positions of the snare drum detected by the snare drum detector; a two-beat shift determination unit configured to determine whether the bar beginning of the music piece data is shifted by two beats on a basis of the sounding positions of the bass drum detected by the bass drum detector; and a bar beginning setting unit configured to set the bar beginning of the music piece data on a basis of results determined by the one-beat shift determination unit and the two-beat shift determination unit.

BRIEF DESCRIPTION OF DRAWING(S)

FIG. 1 schematically illustrates a concept of the invention.

FIG. 2 schematically illustrates an exemplary rhythm pattern that is a target of the invention.

FIG. 3 schematically illustrates another exemplary rhythm pattern that is a target of the invention.

FIG. 4 schematically illustrates still another exemplary rhythm pattern that is a target of the invention.

DESCRIPTION OF EMBODIMENT(S)

Exemplary embodiment(s) of the invention will be described below with reference to the attached drawings.

1. Concept of Invention

Figure 1:
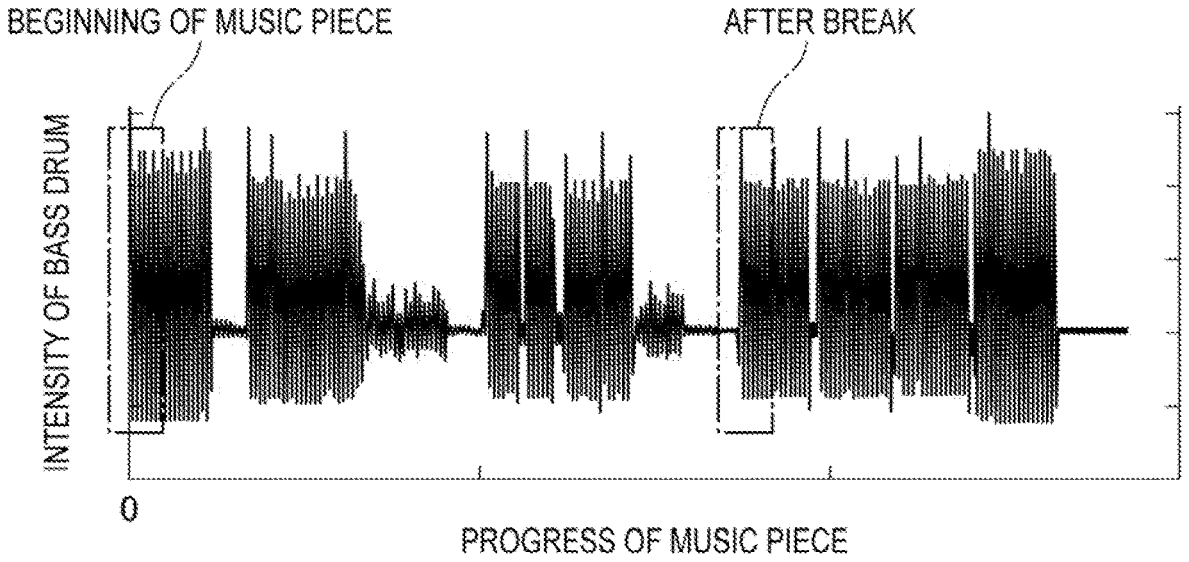

FIG. 1 shows a typical method of detecting a bar beginning. Typically, the bar beginning is detected on a basis of sounding positions of a bass drum. Accordingly, when detecting a beginning of a music piece and a bar beginning after a break, an initial position at which a sound intensity of the bass drum is increased from a previous silent part may be detected as the bar beginning.

However, in fact, the position at which the sound intensity of the bass drum is increased after a break does not always show the bar beginning and the position of the bar beginning needs to be corrected.

Accordingly, in an exemplary embodiment of the invention, the bar beginning is determined using the tendency that sounding positions of a snare drum are often at second and fourth beats and an initial sounding position of the bass drum is often at a first beat in a music piece.

Figure 2:
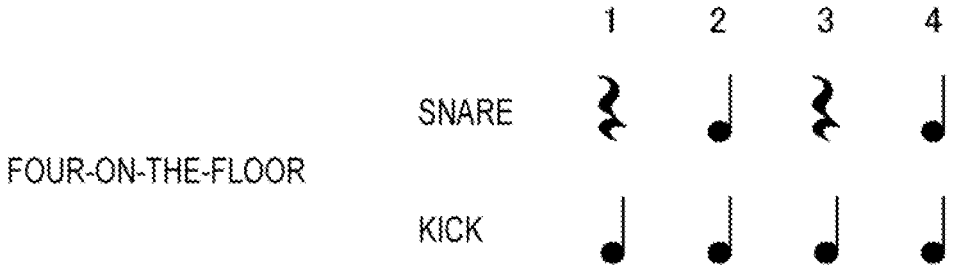
Figure 3:
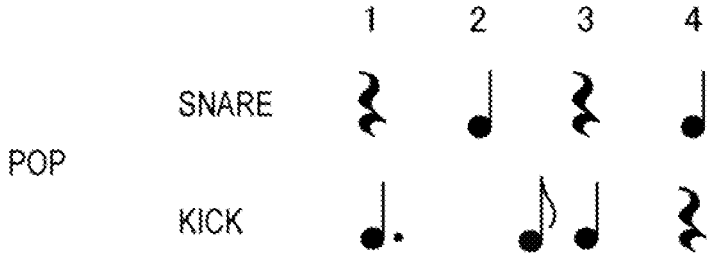
Figure 4:
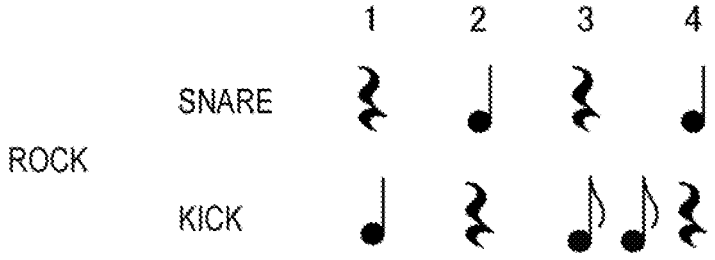

Specifically, for instance, in a rhythm pattern of four-on-the-floor shown in FIG. 2, the sounding positions of the snare drum are at the second and fourth beats, and the initial sounding position of the bass drum is at the first beat. Also in POP rhythm pattern shown in FIG. 3, the sounding positions of the snare drum are at the second and fourth beats, and the initial sounding position of the bass drum is at the first beat. Further, also in Rock rhythm pattern, the sounding positions of the snare drum are at the second and fourth beats, and the initial sounding position of the bass drum is at the first beat. In the exemplary embodiment, the bar beginning of music piece data SD (see FIG. 5) is determined using these characteristics in common among the above rhythm patterns.

2. Structure of Music Piece Analyzer 1

Figure 5:
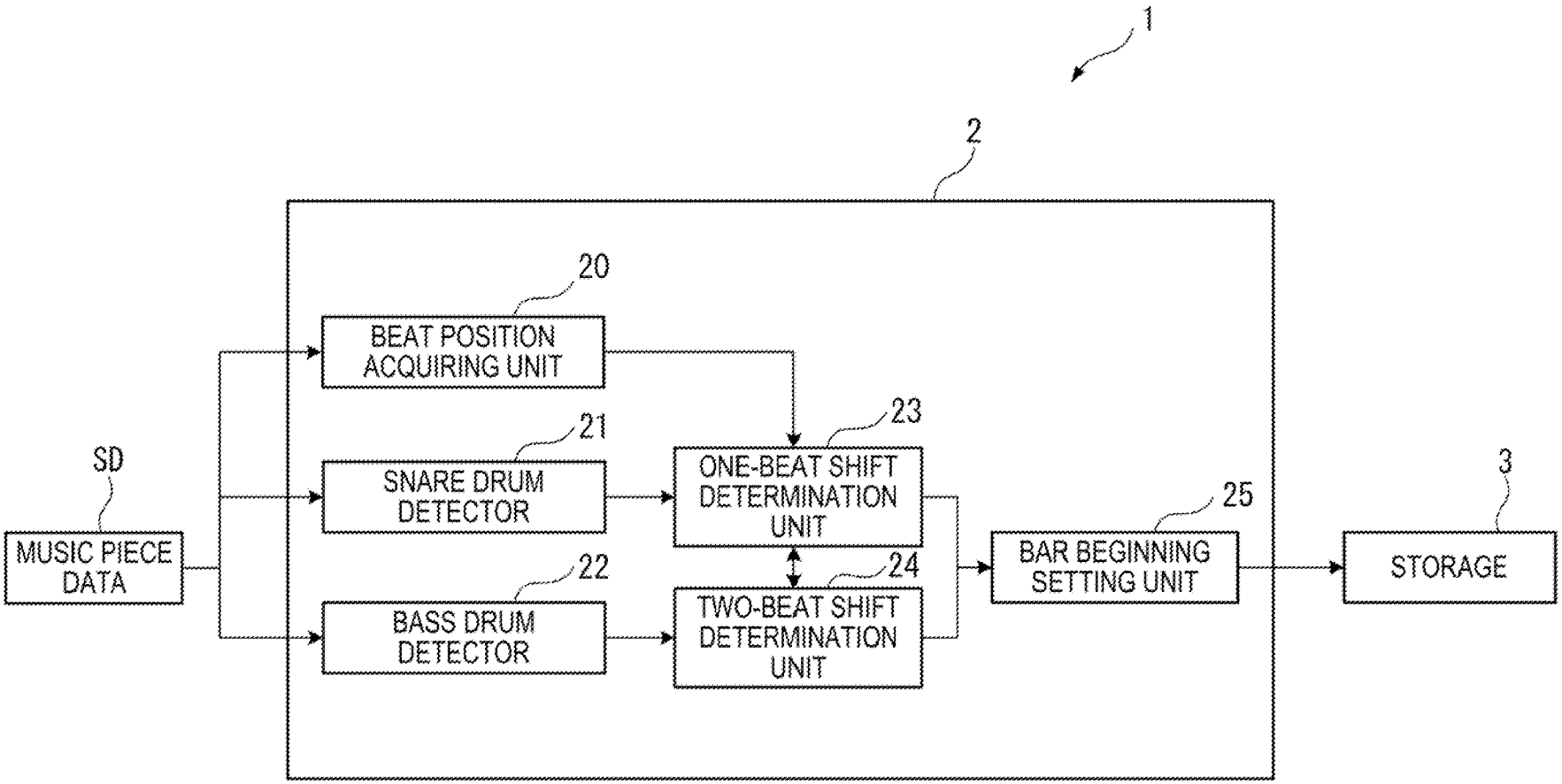
FIG. 5 is a block diagram showing a structure of a music piece analyzer according to a first exemplary embodiment of the invention.

FIG. 5 shows a music piece analyzer 1 according to a first exemplary embodiment of the invention. The music piece analyzer 1 is in a form of a computer including a CPU 2 and a storage 3 (e.g., a hard disc).

The music piece analyzer 1 analyzes bar positions in the inputted music piece data SD with reference to beat positions of the music piece data SD, enters the analyzed bar positions in the music piece data SD, and stores the music piece data SD in the storage 3.

The music piece data SD in a form of digital data (e.g., WAV and MP3) has been analyzed in terms of the beat position of the music piece by FFT analysis and the like. The music piece data SD may be provided by importing music piece data, which has been played in a music player (e.g., CD player and DVD player), into the music piece analyzer 1 through a USB cable and the like, or may be provided by playing the digital music piece data stored in the storage 3.

The music piece analyzer 1 includes a beat position acquiring unit 20, a snare drum detector 21, a bass drum detector 22, a one-beat shift determination unit 23, a two-beat shift determination unit 24, and a bar beginning setting unit 25, which function as a music piece analysis program to be executed in the CPU 2.

The beat position acquiring unit 20 acquires beat positions obtained by analyzing the music piece data SD. Although the beat positions are acquired from the music piece data SD having the beat position analyzed in advance in the exemplary embodiment, the beat position acquiring unit 20 may detect the beat positions through the FFT analysis and the like. The beat position acquiring unit 20 outputs the acquired beat positions of the music piece data SD to the one-beat shift determination unit 23 and the two-beat shift determination unit 24.

The snare drum detector 21 detects sounding positions of the snare drum in the music piece data SD. Specifically, the snare drum detector 21 subjects the inputted music piece data SD to an LPF processing at a cutoff frequency of 2.5 kHz. Next, the snare drum detector 21 subjects the music piece data SD to a HPF (High Pass Filter) processing at the cutoff frequency of 300 Hz, thereby excluding sounds of the bass drum in a low-pitch sound range and detecting sounds of the snare drum in a medium-pitch sound range.

The snare drum detector 21 differentiates the detection data to detect the data of a large change as the sounding positions of the snare drum.

Although the snare drum detector 21 directly detects the sounding positions of the snare drum from the music piece data SD in the exemplary embodiment, the snare drum detector 21 may acquire the sounding positions of the snare drum detected by an external device.

The snare drum detector 21 outputs the detected sounding positions of the snare drum to the one-beat shift determination unit 23.

The bass drum detector 22 detects sounding positions of the bass drum in the music piece data SD. Specifically, the bass drum detector 22 subjects the inputted music piece data SD to the LPF processing at the cutoff frequency of 2.5 kHz. Next, the bass drum detector 22 subjects the music piece data SD to the LPF (Low Pass Filter) processing at the cutoff frequency of 240 Hz to detect sounds of the bass drum in a low-pitch sound range equal to or less than a predetermined frequency.

The bass drum detector 22 differentiates the detection data to detect the data of a large change as the sounding positions of the bass drum.

Although the bass drum detector 22 directly detects the sounding positions of the bass drum from the music piece data SD in the exemplary embodiment, the bass drum detector 22 may acquire the sounding positions of the bass drum detected by an external device.

The bass drum detector 22 outputs the detected sounding positions of the bass drum to the two-beat shift determination unit 24.

Although the snare drum detector 21 and the bass drum detector 22 respectively detect an attack sound of the snare drum and an attack sound of the bass drum in the exemplary embodiment, any kinds of attack sounds are detectable. For instance, an attack sound of clap may be detected in place of the attack sound of the snare drum and an attack sound of slap of a bass guitar may be detected in place of the attack sound of the bass drum.

The one-beat shift determination unit 23 determines whether the sounding positions of the snare drum are the second and fourth beat positions or the first and third beat positions with reference to the initial beat position of the music piece data SD on a basis of the beat positions of the music piece data SD acquired by the beat position acquiring unit 20.

Figure 6:
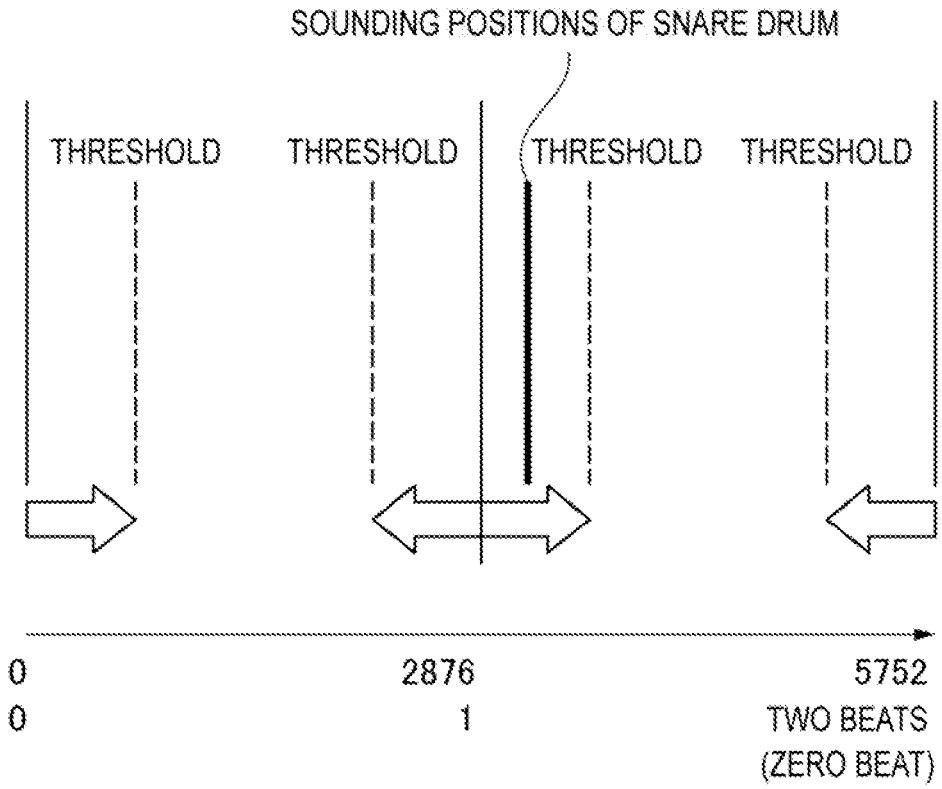
FIG. 6 is a graph for explaining a determination method using a one-beat shift determination unit in the first exemplary embodiment.

Specifically, on a basis of whether the sounding positions of the snare drum are present between thresholds set for the beat positions as shown in FIG. 6, the one-beat shift determination unit 23 detects the beat positions of the snare drum and determines whether the detected beat positions of the snare drum are the second and fourth beat positions.

The one-beat shift determination unit 23 divides the sounding positions of the snare drum by the sampling number of two beats and determines whether the sounding positions of the snare drum are at the second and fourth beats on a basis of a remainder of the division.

When the remainder accounts for almost zero beat in term of the sampling number, the one-beat shift determination unit 23 determines that the sounding positions of the snare drum are at even number beats.

When the remainder accounts for almost one beat in term of the sampling number, the one-beat shift determination unit 23 determines that the sounding positions of the snare drum are at odd number beats.

Such a sounding position as having the remainder falling out of the thresholds is excluded from the sounding positions of the snare drum.

The one-beat shift determination unit 23 determines the remainder for all the sounding positions of the snare drum in the music piece data SD, and calculates a ratio of the sounding positions of the snare drum that are determined to be at the odd number beats in the determination results.

When the ratio of the sounding positions of the snare drum determined to be at the odd number beats exceeds a predetermined threshold, the one-beat shift determination unit 23 determines as a result of the one-beat shift determination that the music piece data SD is shifted by one beat (i.e., one-beat shift). When the one-beat shift determination unit 23 determines that the music piece data SD is shifted by one beat, the one-beat shift determination unit 23 outputs a flag of "1" to the bar beginning setting unit 25 as the determination result. When the one-beat shift determination unit 23 determines that the music piece data SD is not shifted by one beat, the one-beat shift determination unit 23 outputs a flag of "0" to the bar beginning setting unit 25 as the determination result.

The two-beat shift determination unit 24 determines whether the sounding positions of the bass drum are at the first beat or the third beat on a basis of the beat positions in the music piece data SD acquired by the beat position acquiring unit 20.

Figure 7:
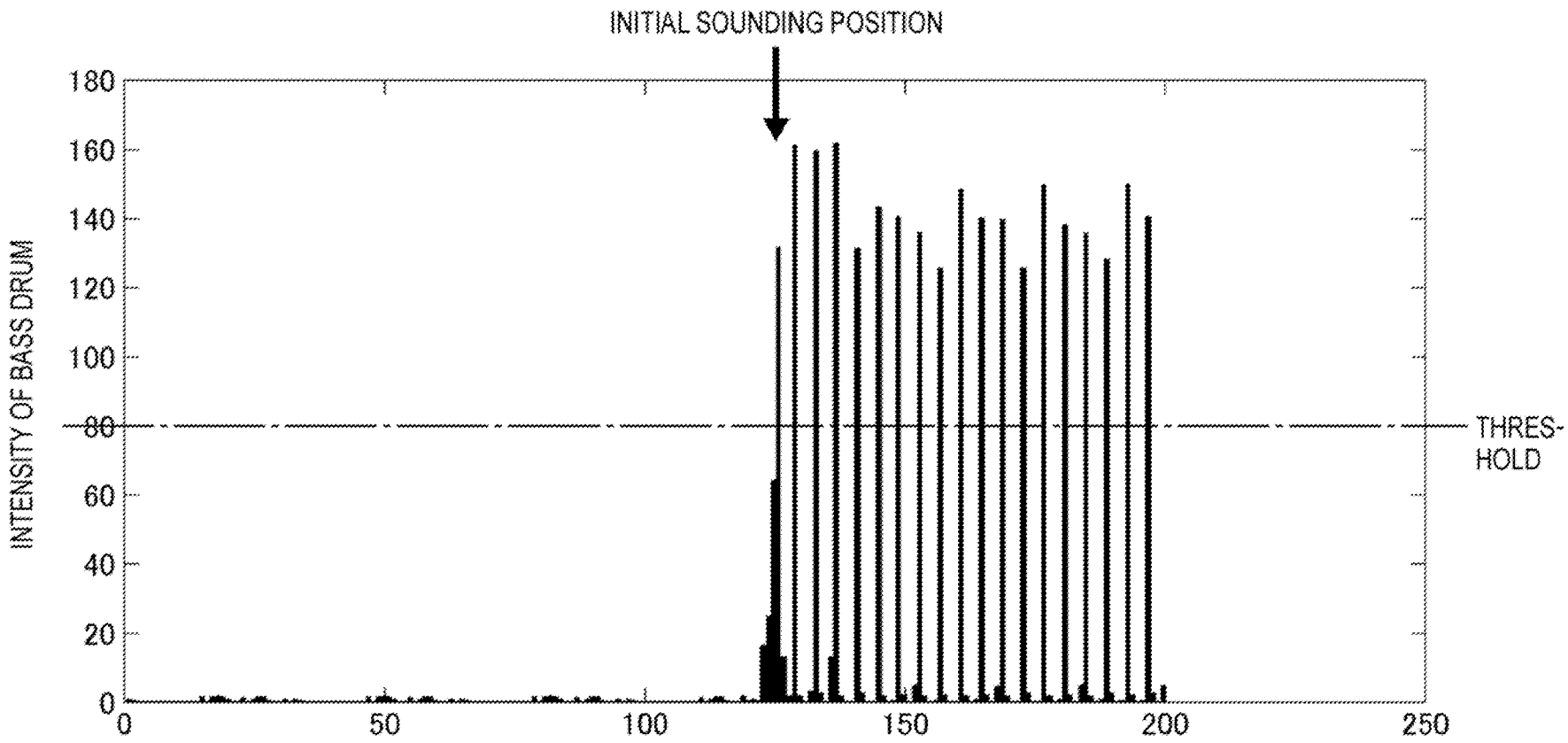
FIG. 7 is a graph for explaining a determination method using a two-beat shift determination unit in the first exemplary embodiment.

Specifically, as shown in FIG. 7, the two-beat shift determination unit 24 initially detects an initial sounding position of the bass drum at which the sound intensity of the bass drum exceeds the predetermined threshold. At this time, the two-beat shift determination unit 24 detects the sounding positions of the bass drum at an accuracy of an interval of a semiquaver from a beginning of the music piece data SD. Since it only needs to be determined whether the sounding positions of the bass drum are at the first beat or the third beat, an up beat appearing in an anacrusis or the like and an attack sound of the bass drum at the fourth beat can be ignored.

The two-beat shift determination unit 24 determines whether the sounding position of the bass drum is at the first beat or the third beat with reference to a value obtained by adding 1 to the remainder obtained from the calculation of (the initial sounding position of the bass drum outstandingly rising in the music piece data SD−1)/16. It should be noted that "16" in the division means that one bar is divided by an interval of a semiquaver. Moreover, 1 is subtracted from the sounding position of the bass drum in order to convert the sounding portion into data consisting of 0 to 15, and 1 is added to the remainder in order to return the remainder to data consisting of 1 to 16.

When the value obtained by adding 1 to the remainder is approximately 9, which shows a position close to the third beat, the two-beat shift determination unit 24 determines that the sounding position of the bass drum is at the third beat shifted by two beats.

When the value obtained by adding 1 to the remainder is other than approximately 9, the two-beat shift determination unit 24 determines that the sounding position of the bass drum is not shifted by two beats but present at the first beat.

When the two-beat shift determination unit 24 determines that the sounding position of the bass drum is shifted by two beats, the two-beat shift determination unit 24 outputs a flag of "1" as the determination result to the bar beginning setting unit 25. When the two-beat shift determination unit 24 determines that the sounding position of the bass drum is not shifted by two beats, the two-beat shift determination unit 24 outputs a flag of "0" as the determination result to the bar beginning setting unit 25.

The bar beginning setting unit 25 sets the bar beginning of the music piece data SD on a basis of the determination results of the one-beat shift determination unit 23 and the two-beat shift determination unit 24.

Specifically, the bar beginning setting unit 25 calculates a total shift amount with reference to the flag of "0" or "1" outputted from the one-beat shift determination unit 23 and the flag of "0" or "1" outputted from the two-beat shift determination unit 24. The total shift amount is calculated in accordance with (one-beat shift determination result)+(two-beat shift determination result)×2.

The bar beginning setting unit 25 adds the total shift amount to the initial beat position of the music piece data SD to set the bar beginning. Since the total shift amount is a value of 0, 1, 2 or 3, the bar beginning setting unit 25 sets the initial beat position as the bar beginning when the total shift amount is 0. When the total shift amount is 1, the setting unit 25 sets the next beat position as the bar beginning. When the total shift amount is 2, the setting unit 25 sets the third beat position as the bar beginning. When the total shift amount is 3, the setting unit 25 sets the fourth beat position as the bar beginning.

The bar beginning setting unit 25 enters the set bar beginning position in the music piece data SD to store the music piece data SD in the storage 3.

3. Operations and Advantages in Exemplary Embodiment

Figure 8:
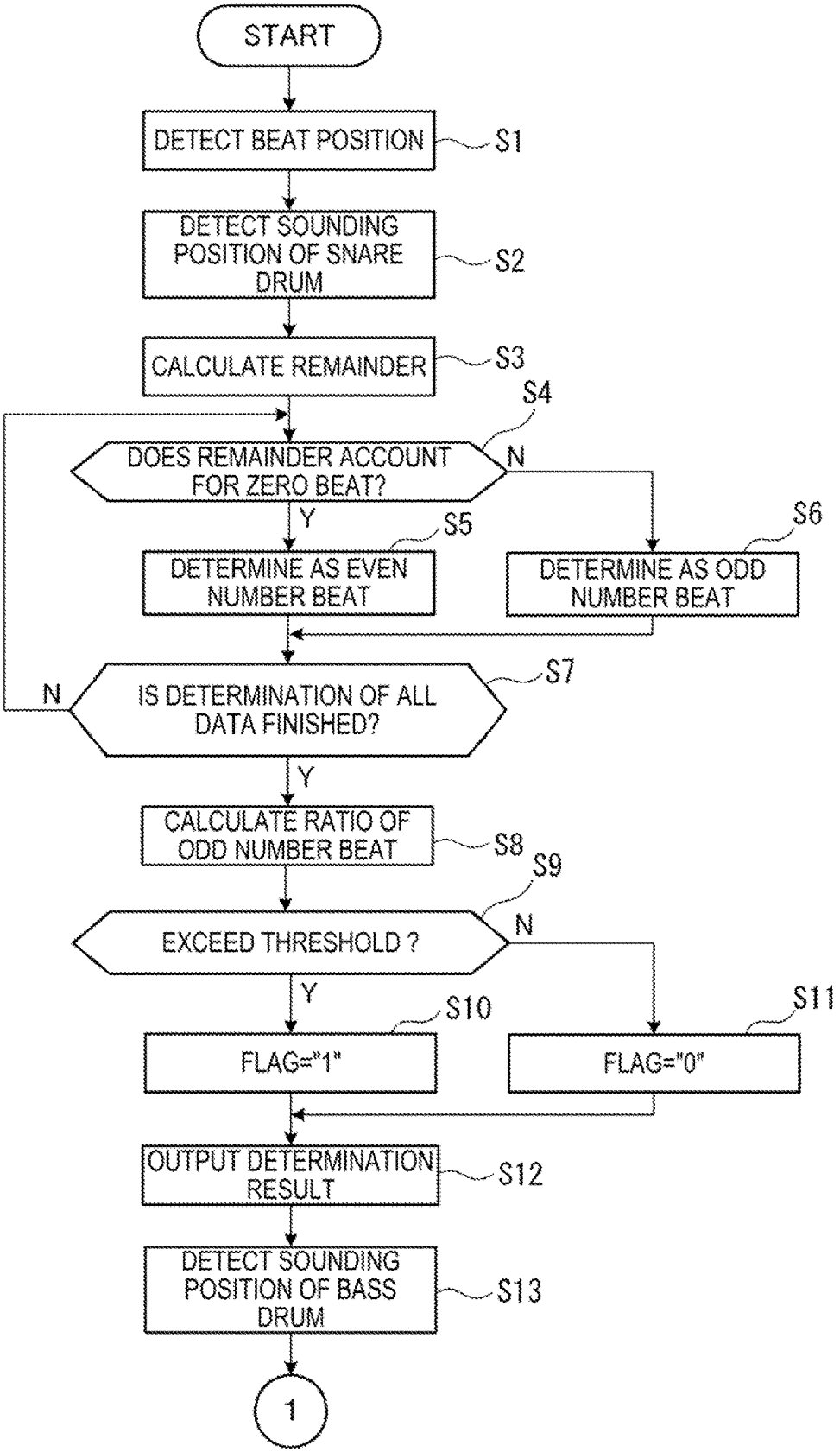
FIG. 8 is a flowchart for explaining operations in the first exemplary embodiment.
Figure 9:
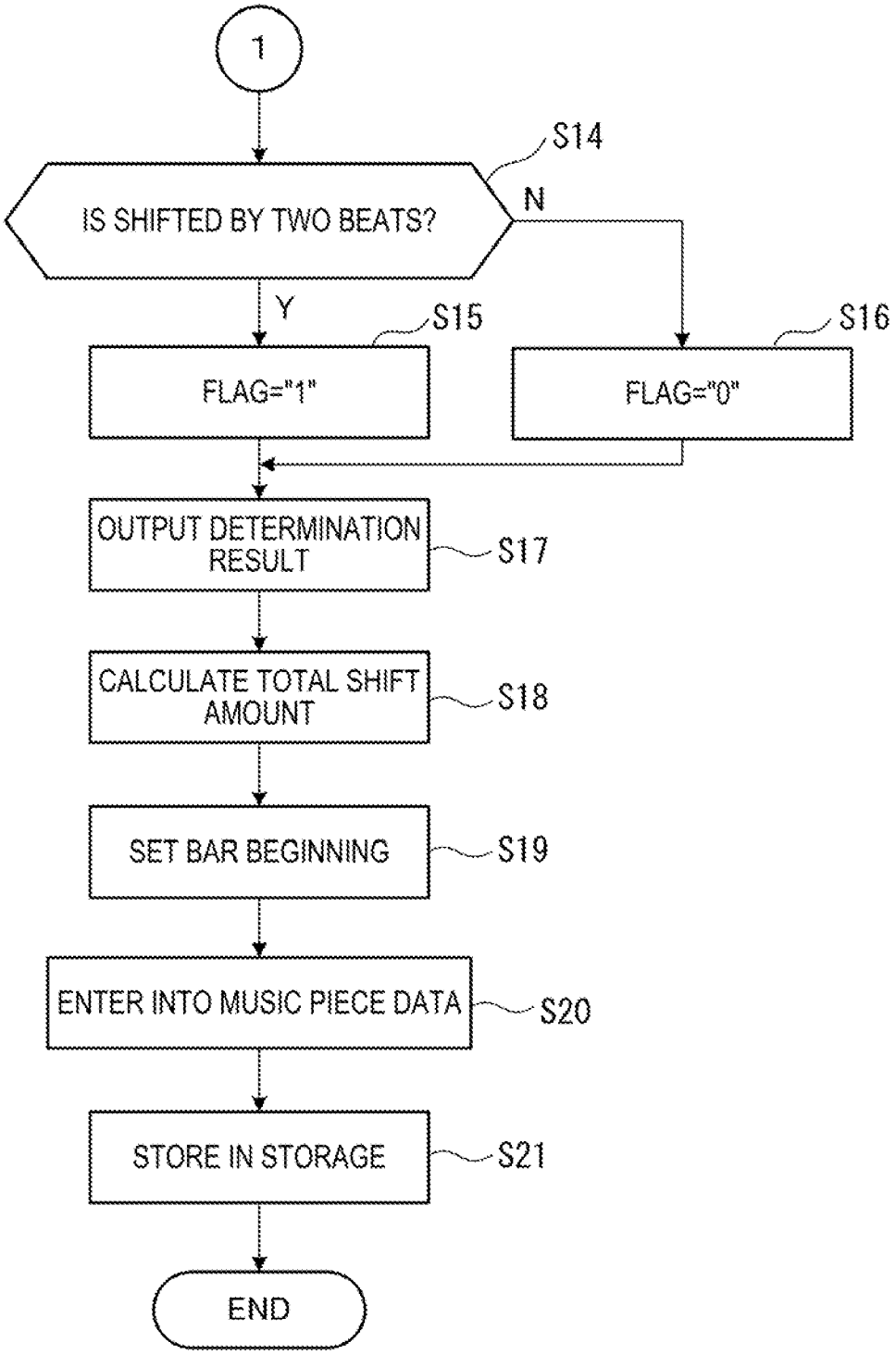
FIG. 9 is a next flowchart for explaining the operations in the first exemplary embodiment.

Next, operations in the exemplary embodiment will be described with reference to flowcharts shown in FIGS. 8 and 9.

The beat position acquiring unit 20 detects the beat positions in the music piece data SD (Step S1).

The snare drum detector 21 detects sounding positions of the snare drum in the music piece data SD (Step S2).

The one-beat shift determination unit 23 divides each of the sounding positions of the snare drum by a sampling time of two beats to calculate a remainder (Step S3).

The one-beat shift determination unit 23 determines whether the remainder accounts for zero beat (Step S4).

When the remainder accounts for zero beat, the one-beat shift determination unit 23 determines that the sounding position of the snare drum is at an even number beat (Step S5).

When the remainder does not account for zero beat, the one-beat shift determination unit 23 determines that the sounding position of the snare drum is at an odd number beat (Step S6).

The one-beat shift determination unit 23 determines whether the one-beat shift determination has been completed for all the sounding positions of the snare drum in the music piece data SD (Step S7).

When the one-beat shift determination has not been completed, the one-beat shift determination unit 23 executes Step S4 and subsequent steps.

When all the sounding positions of the snare drum in the music piece data SD have been determined in terms of the one-beat shift, the one-beat shift determination unit 23 calculates a ratio of the odd number beats (Step S8).

The one-beat shift determination unit 23 determines whether the ratio of the odd number beat exceeds a predetermined threshold (Step S9).

When the ratio of the odd number beat exceeds the predetermined threshold, the one-beat shift determination unit 23 sets the flag of "1" (Step S10).

When the ratio of the odd number beat does not exceed the predetermined threshold, the one-beat shift determination unit 23 sets the flag of "0" (Step S11).

The one-beat shift determination unit 23 outputs the determination results to the bar beginning setting unit 25 (Step S12).

The bass drum detector 22 detects the sounding positions of the bass drum (Step S13).

The two-beat shift determination unit 24 determines whether the initially detected sounding position exceeding the threshold is shifted by two beats (Step S14).

When determining that the initially detected sounding position exceeding the threshold is shifted by two beats, the two-beat shift determination unit 24 sets the flag "1" (Step S15).

When determining that the initially detected sounding position exceeding the threshold is not shifted by two beats, the two-beat shift determination unit 24 sets the flag "0" (Step S16).

The two-beat shift determination unit 24 outputs the determination results to the bar beginning setting unit 25 (Step S17).

The bar beginning setting unit 25 calculates the total shift amount on a basis of the determination results outputted from the one-beat shift determination unit 23 and the two-beat shift determination unit 24 (Step S18).

The bar beginning setting unit 25 sets the bar beginning of the music piece data SD on a basis of the calculated total shift amount (Step S19).

The bar beginning setting unit 25 enters the data, in which the bar beginning is set, into the music piece data SD (Step S20).

The bar beginning setting unit 25 stores the music piece data SD, in which the bar beginning is entered, in the storage 3 (Step S21).

According the exemplary embodiment, the one-beat shift determination unit 23 determines whether the initial beat position is shifted by one beat on a basis of the sounding positions of the snare drum in the music piece data SD and the beat positions acquired by the beat position acquiring unit 20. The two-beat shift determination unit 24 determines whether the initial beat position is shifted by two beats on a basis of the sounding positions of the bass drum in the music piece data SD and the beat positions acquired by the beat position acquiring unit 20. Accordingly, the bar beginning setting unit 25 can set the bar beginning at a high accuracy.

4. Second Exemplary Embodiment

Next, a second exemplary embodiment of the invention will be described. In the description below, the explanation of the same components as the above will be omitted by providing the same reference signs to the components.

In the first exemplary embodiment, the music piece analyzer 1 includes the one-beat shift determination unit 23 and the two-beat shift determination unit 24, and the bar beginning setting unit 25 sets the bar beginning of the music piece data SD on a basis of the determination results of the one-beat shift determination unit 23 and the two-beat shift determination unit 24.

Figure 10:
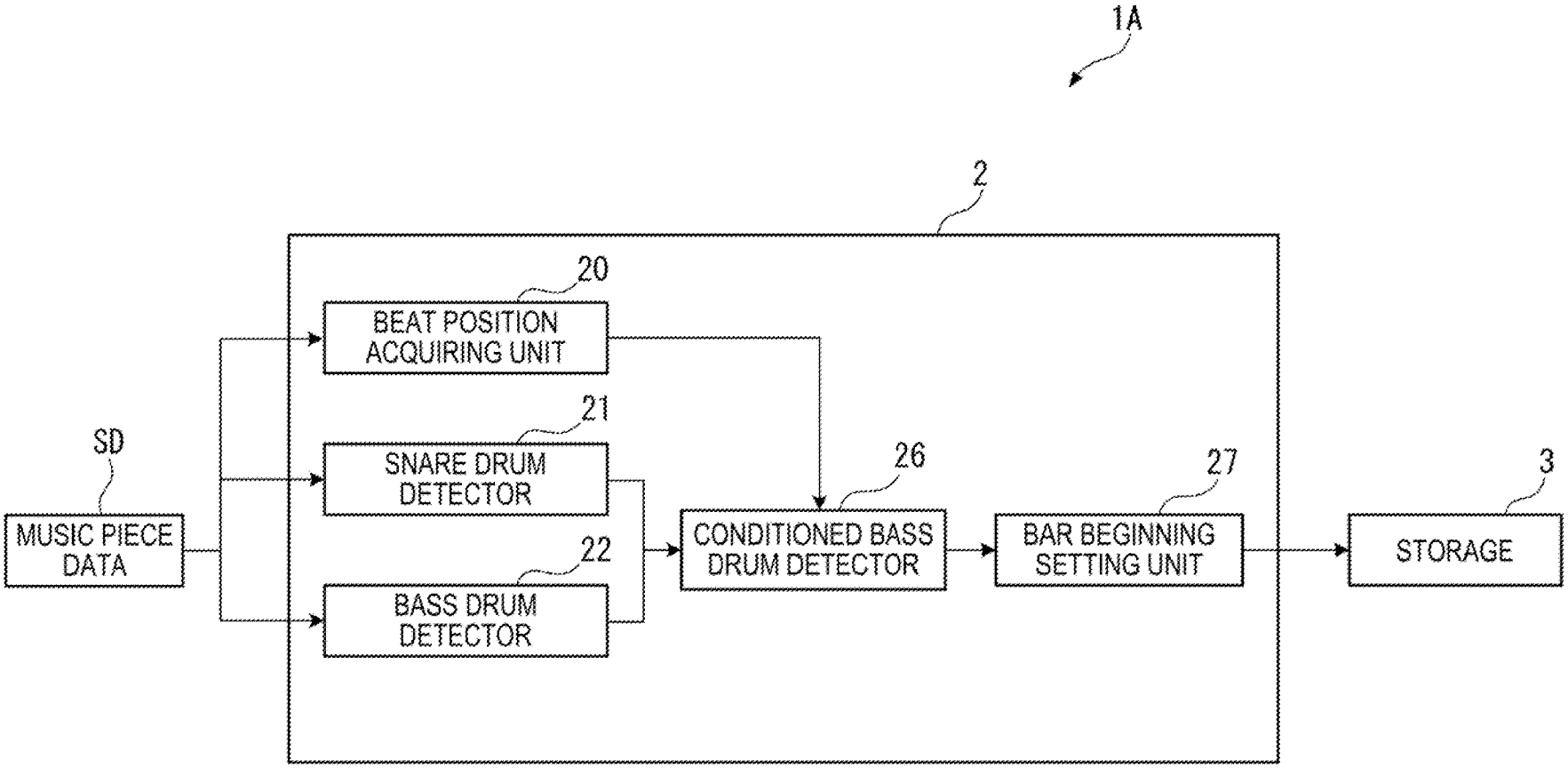
FIG. 10 is a block diagram showing a structure of a music piece analyzer according to a second exemplary embodiment of the invention.

In contrast, the second exemplary embodiment is different from the first exemplary embodiment in that a music piece analyzer 1A includes a conditioned bass drum detector 26 and a bar beginning setting unit 27 as shown in FIG. 10, the bar beginning setting unit 27 setting the bar beginning on a basis of the detection result of the conditioned bass drum detector 26.

The conditioned bass drum detector 26 (detector) detects the sounding positions of the bass drum, which are positions one beat before the sounding positions of the snare drum detected by the snare drum detector 21, on a basis of the beat positions in the music piece data SD acquired by the beat position acquiring unit 20. The conditioned bass drum detector 26 outputs the sounding positions of the bass drum to the bar beginning setting unit 27.

The bar beginning setting unit 27 sets, as the bar beginning, the first sounding position of the bass drum from the beginning of the music piece data SD, at which position a sound power of the bass drum is above a predetermined threshold.

Figure 11:
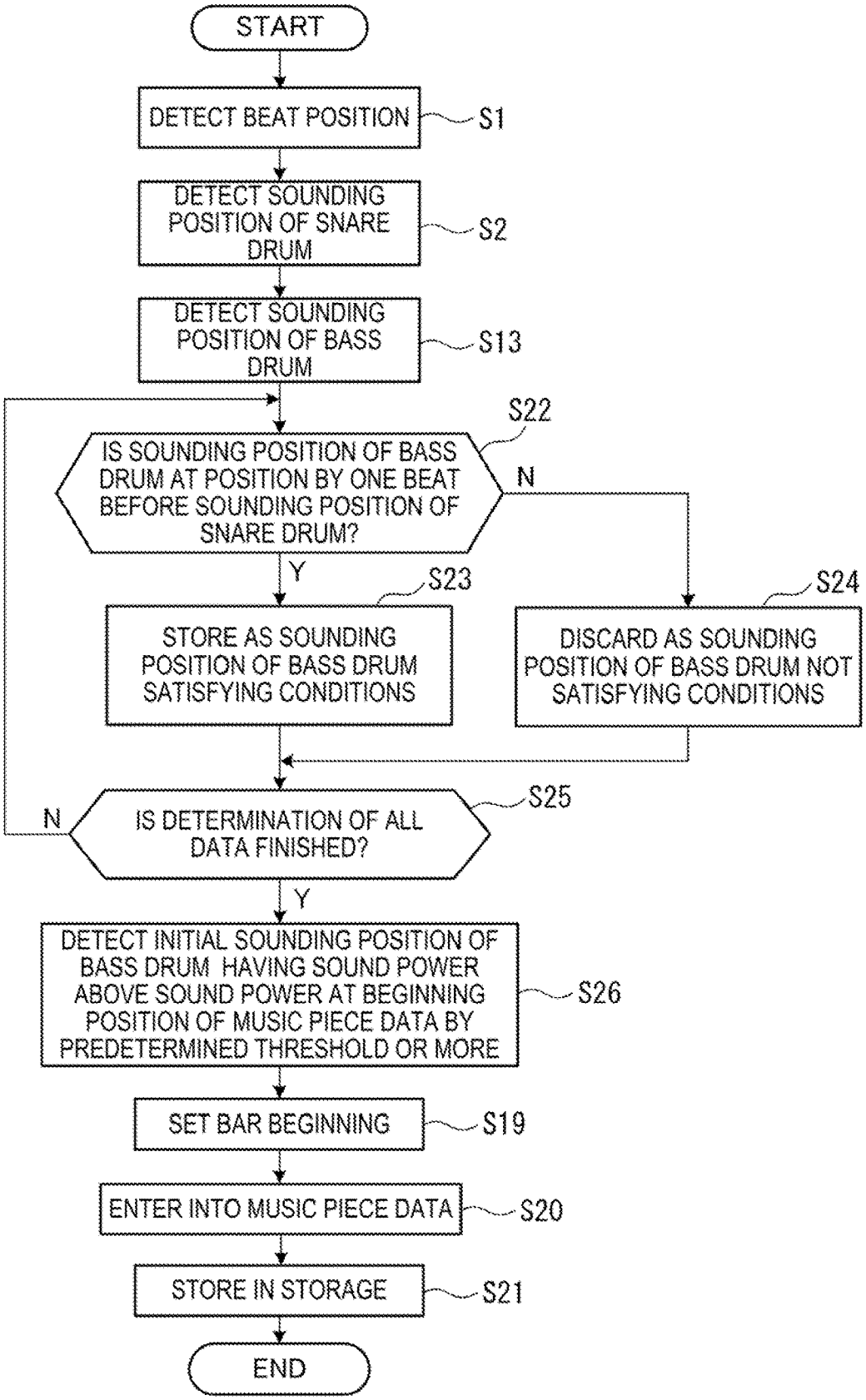
FIG. 11 is a flowchart for explaining the operations in the second exemplary embodiment.

In operations of the second exemplary embodiment as shown in the flowchart of FIG. 11, the beat position acquiring unit 20 acquires the beat positions of the music piece data SD (Step S1), and the snare drum detector 21 detects the sounding positions of the snare drum (Step S2). Subsequently, the bass drum detector 22 detects the sounding positions of the bass drum (Step S13).

The conditioned bass drum detector 26 determines whether the sounding positions of the bass drum are positions one beat before the sounding positions of the snare drum on a basis of the detected sounding positions of the snare drum (Step S22).

When the conditioned bass drum detector 26 determines that the sounding positions of the bass drum are present one beat before the sounding positions of the snare drum, the conditioned bass drum detector 26 stores the sounding positions of the bass drum (Step S23). When the conditioned bass drum detector 26 determines that the sounding positions of the bass drum are not present one beat before the sounding positions of the snare drum, the conditioned bass drum detector 26 discards the sounding positions of the bass drum (Step S24).

The conditioned bass drum detector 26 continues to determine the sounding positions of the bass drum in all the data of the music piece data SD (Step S25). After determining the sounding positions of the bass drum in all the data, the conditioned bass drum detector 26 outputs the stored sounding positions of the bass drum to the bar beginning setting unit 27.

The bar beginning setting unit 27 detects the first sounding position of the bass drum from the beginning of the music piece data SD, at which position the sound power of the bass drum is above a predetermined threshold (Step S26), and sets the detected first sounding position of the bass drum as the bar beginning (Step S19).

The bar beginning setting unit 25 enters the data, in which the bar beginning is set, into the music piece data SD (Step S20).

The bar beginning setting unit 25 stores the music piece data SD, in which the bar beginning is entered, in the storage 3 (Step S21).

Also according to the second exemplary embodiment, the same operations and advantages as described above are obtainable.

The invention claimed is:

1. A music piece analyzer comprising:

a beat position acquiring unit configured to detect beat positions in music piece data or acquire the beat positions detected by an external device;

a snare drum position detector configured to detect sounding positions of a snare drum in the music piece data or acquire the sounding positions of the snare drum detected by an external device;

a bass drum position detector configured to detect sounding positions of a bass drum in the music piece data or acquire the sounding positions of the bass drum detected by an external device;

a bass drum position extractor configured to extract the sounding positions of the bass drum positioning one beat before the sounding positions of the snare drum; and a bar beginning setting unit configured to set, as a bar beginning, a first sounding position from a beginning of the music piece data, the first sounding position being one of the extracted sounding positions of the bass drum, at which position a sound power of the bass drum is above a predetermined threshold.

2. A music piece analyzer comprising:

a beat position acquiring unit configured to detect beat positions in music piece data or acquire the beat positions detected by an external device;

a snare drum detector configured to detect sounding positions of a snare drum in the music piece data or acquire the sounding positions of the snare drum detected by an external device;

a bass drum detector configured to detect sounding positions of a bass drum in the music piece data or acquire the sounding positions of the bass drum detected by an external device;

a one-beat shift determination unit configured to determine whether a bar beginning of the music piece data is shifted by one beat on a basis of the sounding positions of the snare drum detected by the snare drum detector;

a two-beat shift determination unit configured to determine whether the bar beginning of the music piece data is shifted by two beats on a basis of the sounding positions of the bass drum detected by the bass drum detector; and a bar beginning setting unit configured to set the bar beginning of the music piece data on a basis of results determined by the one-beat shift determination unit and the two-beat shift determination unit.

3. The music piece analyzer according to claim 2, wherein the one-beat shift determination unit determines whether the sounding positions of the snare drum are at second and fourth beats or first and third beats, and the two-beat shift determination unit determines whether the sounding positions of the bass drum are at the first beat or the third beat.

4. The music piece analyzer according to claim 2, wherein the two-beat shift determination unit performs the determination at an accuracy of an interval of a semiquaver.

5. A computer-readable medium that stores a program code configured to enable a computer to function as:

when read and run by the computer, a beat position acquiring unit configured to detect beat positions in music piece data or acquire beat positions detected by an external device;

a snare drum detector configured to detect sounding positions of a snare drum in the music piece data or acquire the sounding positions of the snare drum detected by an external device;

a bass drum detector configured to detect sounding positions of a bass drum in the music piece data or acquire the sounding positions of the bass drum detected by an external device;

a one-beat shift determination unit configured to determine whether a bar beginning of the music piece data is shifted by one beat on a basis of the sounding positions of the snare drum detected by the snare drum detector;

a two-beat shift determination unit configured to determine whether the bar beginning of the music piece data is shifted by two beats on a basis of the sounding positions of the bass drum detected by the bass drum detector; and a bar beginning setting unit configured to set the bar beginning of the music piece data on a basis of results determined by the one-beat shift determination unit and the two-beat shift determination unit.

* * * * *